United States Patent [19]

Kreisberg et al.

[11] Patent Number: 4,859,177

[45] Date of Patent: Aug. 22, 1989

[54] APPARATUS FOR INCINERATING COMBUSTIBLE MATERIAL

[75] Inventors: Alan J. Kreisberg, Bethlehem, Pa.; Millard E. Prowler, North Hills, N.Y.

[73] Assignee: Fuller Company, Bethlehem, Pa.

[21] Appl. No.: 293,546

[22] Filed: Jan. 3, 1989

Related U.S. Application Data

[63] Continuation of Ser. No. 156,135, Feb. 16, 1988, abandoned.

[51] Int. Cl.[4] ..... F27D 7/00

[52] U.S. Cl. ..... 432/14; 432/105; 432/106; 432/109

[58] Field of Search ..... 432/103, 105, 110, 106, 432/14

[56] References Cited

U.S. PATENT DOCUMENTS

| | | | |
|---|---|---|---|
| 1,904,781 | 4/1933 | Crawford | 432/105 |
| 3,436,061 | 4/1969 | Zinn | 432/109 |
| 4,171,950 | 10/1979 | Bliemeister | 432/106 |
| 4,259,081 | 3/1981 | Reuter et al. | 432/105 |
| 4,462,793 | 7/1984 | Maeda et al. | 432/105 |
| 4,494,928 | 1/1985 | Rohrbach | 432/105 |
| 4,746,290 | 5/1988 | DeCicco et al. | 432/105 |

*Primary Examiner*—Henry C. Yuen

*Attorney, Agent, or Firm*—Frank H. Thomson; Daniel DeJoseph

[57] ABSTRACT

A rotary kiln device for incinerating combustible materials such as municipal and commercial waste materials. The kiln is a co-current gas-material flow apparatus. The kiln is divided by means of a dam into a drying zone and a combustible zone. Waste material is retained within the drying zone sufficiently long so that that moisture contained in the material is driven off. Air for combustion is supplied directly to the combustion zone, bypassing the drying zone so that self-sustaining combustion may take place.

8 Claims, 1 Drawing Sheet

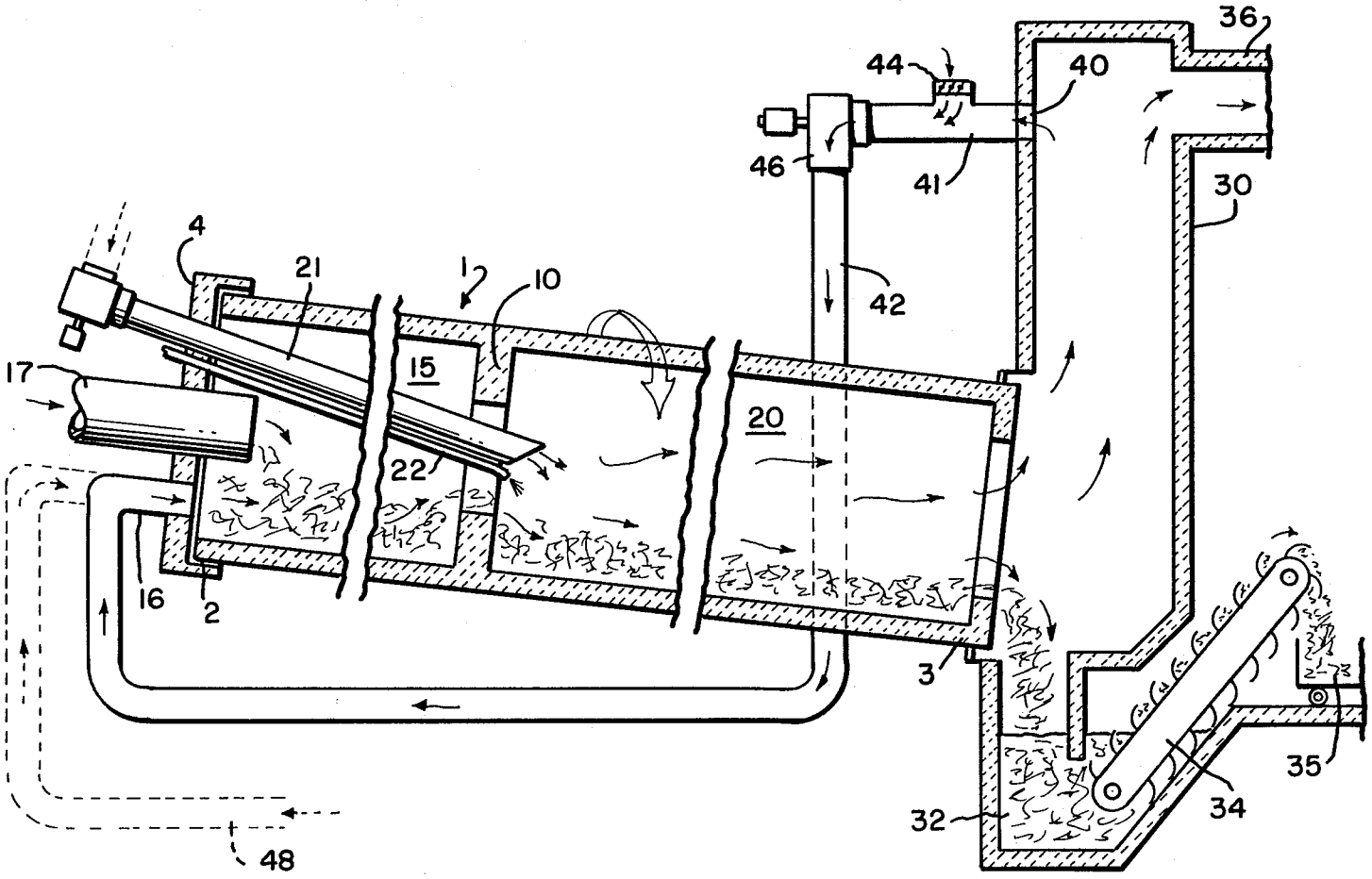
36
30
40
44
41
42
46
20
10
12
15
22
21
4
17
16
2
3
32
34
35
48

APPARATUS FOR INCINERATING COMBUSTIBLE MATERIAL

This application is a continuation of copending application Ser. No. 07/156,135 filed Feb. 16, 1988, now abandoned.

BACKGROUND OF THE INVENTION

This invention relates to an apparatus for incinerating combustible material and in particular to a rotary kiln apparatus for incinerating waste materials such as municipal solid waste or commercial waste materials.

Prior to the present invention, it was known to incinerate municipal, commercial solid waste material and hazardous materials to achieve volume reduction and/or eliminate hazardous elements before being placed in a landfill. Typically, the solid waste includes approximately twenty-five percent non-combustibles (ash), thirty percent moisture, typical ranges are between fifteen percent and seventy-five percent moisture, and forty-five percent combustibles. The higher the percentage of moisture that exists in the waste, the more difficult it is to achieve proper ignition and complete combustion of the combustible materials.

In order to achieve low operating costs, a solid waste incineration system must be designed to utilize a minimum of auxiliary fuel. Most of the heat requirement should come from the heating value in the solid waste.

One method for solid waste incineration is mass burning of the material on a stoker/grate boiler. While this technology is proven and well established, the capital cost for such facilities are high.

Prior to the present invention, rotary kilns have been utilized as a alternate to stoker grate boilers, as they require less capital cost and can be economically utilized for smaller quantities of wasted material. One of the disadvantages of the rotary kiln is that when the material flow in the kiln is counter-current to the gas flow, the gas exit temperature is lowered by the cold, wet feed prior to the gas leaving the kiln. Since the exhaust gases may contain some combustible material or carbon monoxide, extra fuel must be added to an afterburner to complete the combustion of the combustibles in the gas stream.

To burn the solid waste in a rotary kiln in a co-current gas-material or parallel flow configuration, in order to more easily start ignition of the bed of materials, keep exit gas temperatures high, and to keep the use of afterburner auxiliary fuel to a minimum, it is necessary to predry the material. According to present technology, a separate drier is utilized ahead of the kiln to dry the material. This drier is usually a grate drier or rotary drier. This additional piece of equipment requires additional capital outlay and increases installation and operating costs.

An alternate process utilizes mass burning in a water walled waste incineration boiler and associated equipment tend to provide a reduced temperature burning zone because of the cooling effect of the water walls thus encouraging the formation of undesirable combustion byproducts.

According to the present invention, a device has been provided which allows the drying of the solid material to occur inside the rotary kiln in a co-current gas-material flow system. While rotary kilns using co-current or parallel gas and material flow are known as for example in U.S. Pat. No. 3,436,061 issued Apr. 1, 1969, the present invention provides a novel arrangement for achieving predrying and co-current flow of the combustion gases and burning wastes to facilitate high operating temperatures in the range of 1600° F. to 3200° F. in the combustion and discharge zones. These high burning temperatures assisted by radiant reflected heat from the refractory lined kiln together with efficient air supply helps to produce complete combustion and therefore avoids the formation of undesirable by-products such as dioxins, carbon monoxide, combustible particulate material and similar gaseous and particulate emissions in the exhaust gases and ash streams.

SUMMARY

It is therefore the principal object of this invention to provide an apparatus for incinerating combustible material which is capable of achieving complete combustion of the waste material while substantially avoiding the discharge of material which has not achieved complete combustion, in both the solid discharge and in the exhaust gas discharge.

It is a further object of this invention to provide an apparatus for incinerating combustible material which integrates the drying zone with the combustion zone to provide reduced capital costs.

In general, the foregoing and other objects will be carried out by providing an apparatus for incinerating combustible material comprising an elongated cylindrical vessel mounted on an incline for rotation about its own axis and having an upper inlet end for receiving material to be incinerated and a lower outlet end for discharging ash from the combustion of said material; means for supplying combustible material to the inlet end of the vessel; dam means for dividing the vessel into a drying zone and a combustion zone and for increasing the retention time of material in the drying zone; means for supplying hot drying gases to said drying zone; means extending through the drying zone for supplying air for combustion directly to said combustion zone bypassing the drying zone; and an outlet for spent drying gases and combustion gases from the vessel flow connected to the lower outlet end of the vessel whereby the flow of gases through the vessel is co-current to the flow of material from the inlet to the outlet and material to be incinerated is first dried in said drying zone, is discharged from said drying zone by displacement over said dam means into said combustion zone, and incinerated in said combustion zone.

The invention consists of a rotary kiln serving as a vessel mounted on an incline for rotation about its own axis. The vessel includes a dam which divides the kiln into a drying zone and a combustion zone. The moist solid waste is supplied to the drying zone together with hot drying gases to flow co-current or parallel with the material flow from the upper inlet end of the kiln to the lower discharge end of the kiln. The dam in the kiln serves to provide retention time for the material within the drying zone compared with a straight through kiln.

Combustion air and an ignition burner extend directly into the combustion zone of the kiln, bypassing the drying zone. If desired, lifters, chains and other internal heat exchange devices well known to those skilled in the art may be included in the drying zone of the kiln to increase the efficiency of the drying zone.

The major portion of the combustion and excess air used to burn the dried waste will enter the rotary kiln at the front end through a burner pipe suspended into the kiln and passing through the drying zone and located for providing combustion air at the front end of the burner zone. Secondary air could also enter the kiln through a separate secondary air pipe separate from the burner pipe. An ignition burner nozzle is located at the beginning of the burning zone to help establish combustion during start-up. Once ignition is established, the dry waste entering the burning zone will ignite without the need for auxiliary fuel.

BRIEF DESCRIPTION OF THE DRAWING

The invention will be described in connection with the annexed drawing wherein the single FIGURE of the drawing is a diagramatic view of the incinerator of the present invention.

DESCRIPTION OF THE PREFERRED EMBODIMENT

Referring to the drawing, the invention consists of a rotary vessel generally indicated at 1 mounted on an incline for rotation about its own axis and generally referred to as a rotary kiln. The kiln includes an upper inlet end 2 for receiving material to be incinerated and combustion air and drying air and a lower outlet end 3 for discharging solid ash which is the product of the incineration and spent drying and combustion gas. The kiln may be mounted on suitable rollers with a drive mechanism, both of which are known to those skilled in the art and need not be described herein. The kiln may also have a suitable end seal arrangement 4 at the inlet end and sealing device (not shown) at the outlet end 3.

The vessel includes a dam means 10 for dividing the vessel into a upper drying zone 15 and a lower combustion or burning zone 20. This means 10 may take the form of a refractory dam, the construction of which will be known to those having ordinary skill in the refractory art. It should have sufficient height to establish suitable retention time in the drying zone depending upon the established feed rate, kiln capacity and anticipated moisture content of the waste to be incinerated.

The apparatus also includes a means 16 for supplying hot gases to the drying zone 15 and a means 17 such as a pipe for supplying solid waste to be incinerated to the drying zone 15.

A conduit means 21 is provided for supplying combustion and excess air to the combustion zone 20. This conduit 20 may be connected to a source of preheated or ambient air. An ignition pipe 22 may be mounted with the pipe 21 to supply ignition fuel to a combustion zone 20 in a manner to be described. The conduit means 21 extends through the drying zone for supplying air for combustion directly to the burning or combustion zone 20, by-passing the drying zone 15.

The outlet end of the kiln may be connected to a stationary combustion chamber 30. The bottom of the stationary combustion chamber may include a pit 32 for receiving ash from the kiln 1. A conveyor 34 is provided for removing ash from the pit and supplying it to a removal system such as a cart 35.

The secondary combustion chamber may have an outlet 36 connected to a waste heat boiler (not shown) and an outlet 40 which is flow connected through ducts 41 and 42 to the inlet 16 for drying gas. These gases may be on the order of between 300° F. and 800° F. If desired, ambient air may be supplied to the conduit 41 through a damper 44 to reduce the temperature of the gases admitted at 16. A hot air fan or blower 46 may be included between the duct 41 and the duct 42.

As an alternate, heated ambient air may be supplied through a conduit 48 from a source (not shown) to the drying chamber. Either or both of these sources of drying air may be utilized.

During the operation of the system, the combustion zone may be maintained at a temperature in the range of 1600° F. to 1800° F. and even up to 3200° F., and the secondary combustion chamber may also be maintained at a temperature in the range of 1600° F. to 1800° F. and up to 3200° F., depending on the waste material being incinerated. If desired, it may be suitable to add a combustion burner to the secondary combustion chamber to complete incineration of combustible gases which might be discharged from the system.

In operation, the solid waste feed is supplied to the drying zone 15 and retained therein by the dam 10. In this drying zone, the heated drying gas supplied through 16 serves to drive off the moisture contained in the waste material preferably without initiating combustion therein. It is preferred that the temperature of the drying gases be high enough to dry the material but not so high as to initiate extensive combustion. As the material tumbles around in the rotating kiln, the material is exposed to the hot co-current flow of gas and material through the vessel.

Lifters may be added to the drying zone so that as the material tumbles within the rotating kiln, it cascades through the flow of hot drying gases. Also, if desired, a chain curtain or other internal heat exchange devices may be included in the drying zone to facilitate the transfer of heat from the hot gas to the moist material. As new material is added, the material is discharged over the dam 10 by displacement into the combustion zone. Preheated combustion air is supplied directly to this zone through inlet 21 and the dried waste material is incinerated therein and finally discharged through outlet 3. In the preferred operation, the combustible waste will have sufficient fuel value to be self-sustaining and maintain the necessary combustion temperatures and the burner and fuel supply line 22 is required only for initial start-up.

The spent drying and combustion gases are discharged into the secondary combustion chamber where there is sufficient retention time to complete combustion of the combustible gases. The ash is discharged into the pit 32 for removal from the system.

From the foregoing it can be seen that the objects of the present invention have been carried out. An economical system has been provided for incinerating combustible waste by providing a drying zone which provides for sufficient retention time to complete the drying of the material. The dried material is then immediately supplied to a combustion zone for incineration. The supply of fresh air directly to the combustion zone insures the complete incineration. The exit gases from the system are not at a reduced temperature as would be the case in the counter-current flow rotary kiln and hence complete combustion of the exhaust gases can take place. Additional fuel is not required in the system because the exhaust gases may at least partially be utilized for drying the incoming feed.

It is intended that the invention not be limited by the foregoing description but be limited solely by that which is within the scope of the appended claims.

We claim:

1. A method for incinerating combustible material comprising the steps of providing an elongated vessel mounted on an incline and having an upper inlet end and a lower outlet end; dividing the vessel into a drying zone and a combustion zone by providing a dam inside the vessel; rotating the vessel about its own axis; supplying material to be incinerated to the drying zone through the upper inlet end of the vessel; supplying hot drying gases to the drying zone for drying the material to be incinerated; discharging the material from the drying zone by displacement over the dam into the combustion zone; supplying air for combustion directly to the combustion zone, by-passing the drying zone for incinerating the dried material in the combustion zone; discharging through the lower outlet end of the vessel ash from the incineration of the material; discharging spent drying and combustion gases from the lower outlet end of the vessel whereby the flow of gases through the vessel is co-current to the flow of material from the inlet of the vessel to the outlet of the vessel; and supplying some of the spent drying and combustion gases discharged from the vessel to the drying zone to carry out the step of supplying hot drying gases to the drying zone.

2. A method of incinerating combustible material according to claim 1 wherein the air for combustion is supplied to said combustion zone through a conduit which extends through the drying zone.

3. A method of incinerating combustible material according to claim 2 further comprising the step of adding ambient air to the spent drying and combustion gases supplied to said drying zone.

4. A method of incinerating combustible material according to claim 1 wherein an ignition burner is utilized to start combustion of the material.

5. A method of incinerating combustible material according to claim 2 wherein an ignition burner is utilized to start combustion of the material.

6. A method of incinerating combustible material according to claim 3 wherein an ignition burner is utilized to start combustion of the material.

7. A method of incinerating combustible material according to claim 5 wherein an ignition burner is utilized to start combustion of the material.

8. A method for incinerating combustible material comprising the steps of providing an elongated vessel mounted on an incline and having an upper inlet end and a lower outlet end; dividing the vessel into a drying zone and a combustion zone by providing a dam inside the vessel; rotating the vessel about its own axis; supplying material to be incinerated to the drying zone through the upper inlet end of the vessel; supplying hot drying gases to the drying zone for drying the material to be incinerated; discharging the material from the drying zone by displacement over the dam into the combustion zone; supplying air for combustion directly to the combustion zone by-passing the drying zone through a conduit which extends through the drying zone for incinerating the dried material in the combustion zone; discharging through the lower outlet end of the vessel ash from the incineration of the material and discharging spent drying and combustion gases from the lower outlet end of the vessel whereby the flow of gases through the vessel is co-current to the flow of material from the inlet of the vessel to the outlet of the vessel.

* * * * *